US007946262B2

(12) United States Patent
Borraccia et al.

(10) Patent No.: US 7,946,262 B2
(45) Date of Patent: May 24, 2011

(54) LIFTER OIL MANIFOLD ASSEMBLY FOR VARIABLE ACTIVATION AND DEACTIVATION OF VALVES IN AN INTERNAL COMBUSTION ENGINE

(75) Inventors: Dominic Borraccia, Spencerport, NY (US); Alan G. Strandburg, Rochester, NY (US); David M. Peers, Rochester, NY (US); Michael J. Dinkel, Penfield, NY (US); Michael E. McCarroll, West Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 526 days.

(21) Appl. No.: 12/012,282

(22) Filed: Feb. 1, 2008

(65) Prior Publication Data

US 2008/0230020 A1 Sep. 25, 2008

Related U.S. Application Data

(60) Provisional application No. 60/919,623, filed on Mar. 23, 2007.

(51) Int. Cl.
*F01L 9/02* (2006.01)

(52) U.S. Cl. ..... 123/90.13; 123/90.12; 123/90.15

(58) Field of Classification Search ..... 123/90.12, 123/90.13, 90.15
See application file for complete search history.

(56) References Cited

U.S. PATENT DOCUMENTS 6,591,796 B1 * 7/2003 Scott ..... 123/90.13

* cited by examiner

*Primary Examiner* — Zelalem Eshete
(74) *Attorney, Agent, or Firm* — Thomas N. Twomey

(57) ABSTRACT

A lifter oil manifold assembly for variable actuation of engine valves having first (top) and second (valve) plates having portions of oil control and oil exhaust passages formed therein. The assembly further includes a carrier member having an oil supply passage integrated thereby separating the oil supply path from the oil control and oil exhaust path. Further, the assembly includes towers for receiving and positioning the electro-magnetic oil control valves used to control oil flow in the assembly. The towers are molded separate from the carrier and are held in place by the valve plate or are molded integral with the carrier. In another aspect of the invention, oil control valve retention springs are molded integral with either the tower or the oil control valve. In a further aspect of the invention, a combined polymer restrictor/strainer in the oil circuit replaces a prior art metal die-cast restrictor.

9 Claims, 9 Drawing Sheets

LIFTER OIL MANIFOLD ASSEMBLY FOR VARIABLE ACTIVATION AND DEACTIVATION OF VALVES IN AN INTERNAL COMBUSTION ENGINE

CROSS-REFERENCE TO RELATED APPLICATIONS

This application claims the benefit of U.S. Provisional Application No. 60/919,623, filed Mar. 23, 2007.

TECHNICAL FIELD

The present invention relates to internal combustion engines; more particularly, to devices for controlling systems in an internal combustion engine; and most particularly, to an improved lifter oil manifold assembly for controlling the flow of engine oil in the variable activation and deactivation of valve lifters in an internal combustion engine. In one embodiment, the mechanism for receiving the oil control valves (OCVs) in the lifter oil manifold assembly and the oil supply, control and exhaust passages are improved. In another embodiment, a simplified restrictor valve, including a filtering element integrated with a restrictor orifice is incorporated in the manifold assembly.

BACKGROUND OF THE INVENTION

In conventional prior art four-stroke internal combustion engines, the mutual angular relationships of the crankshaft, camshaft, and valves are mechanically fixed; that is, the valves are opened and closed fully and identically with every two revolutions of the crankshaft, fuel/air mixture is drawn into each cylinder in a predetermined sequence, ignited by the sparking plug, and the burned residue discharged. This sequence occurs irrespective of the rotational speed of the engine or the load being placed on the engine at any given time.

It is known that for much of the operating life of a multiple-cylinder engine, the load might be met by a functionally smaller engine having fewer firing cylinders, and that at low-demand times fuel efficiency could be improved if one or more cylinders of a larger engine could be withdrawn from firing service. It is known in the art to accomplish this by de-activating the valve train leading to pre-selected cylinders in any of various ways, such as by providing special valve lifters having internal locks which may be switched on and off either electrically or hydraulically. Such switching is conveniently performed via a hydraulic manifold that utilizes electric solenoid valves to selectively pass engine oil to the lifters upon command from an engine control module (ECM). Such a manifold is referred to in the art as a Lifter Oil Manifold Assembly (LOMA).

Prior art LOMAs are made up of several components including a cast aluminum top plate with cast and/or machined oil passages for carrying engine oil under pressure to and from the oil control valves (OCVs), a cast and/or machined aluminum valve plate for receiving the OCVs and connecting the OCVs to the oil passages, a resilient carrier member for sealing between the top plate and valve plate, a lead frame for making electrical connections to the OCVs and, of course, the OCVs themselves.

Thus, prior art LOMAs are typically complex assemblies that include a variety of parts that require individual manufacturing operations, cost, and cycle time. For example, the OCV seat is typically machined into the valve plate and the OCVs are retained in the valve plate with a snap ring. A tolerance gap between the OCV flange and the valve plate is resolved with a wave spring to retain each OCV in the seated position. This assembly works satisfactory however, requires secondary machining to the valve plate. Also, with the spring as a separate part there is a risk that an assembly is built without the spring in place, which could lead to a reciprocating movement of the OCV with the supply pressure. In such a case, the OCV would be susceptible to damage from vibration.

Furthermore, the oil supply gallery is typically integral to the top plate. Consequently, the oil supply gallery is located in the same surface as the control gallery, while it is desirable for a more efficient functionality of the LOMA to position the control path and the supply path in different surfaces.

In still another example, typical prior art LOMAs include four press-in-place metering valves that contain a small orifice in order to act as a flow limiter for engine oil passing through the LOMA. The metering valves are typically made out of zinc die-cast in a two-stage manufacturing process and contain no immediate contaminant protection that may, for example, screen out debris from the engine oil, which could damage or block the small orifice.

What is needed in the art is an improved and simplified LOMA that involves fewer parts to be assembled, that involves parts that can be easily manufactured, and that can be easily integrated into a high volume manufacturing operation.

It is a principal object of the present invention to provide an improved LOMA for controlling the hydraulic locking and unlocking of deactivatable valve lifters in an internal combustion engine, wherein the oil supply gallery is located in the gasket carrier, and wherein the OCV seats are formed separate from the cast aluminum valve plate by injection molding of a polymer.

It is a further object of the invention to provide such a LOMA wherein a simplified orifice restrictor, coupled with a strainer for keeping unwanted debris away from the orifice restrictor, is used.

It is a still further object of the invention to provide such an assembly comprising components, which may be easily fabricated, and preferably which are formed of a suitable thermoplastic polymer wherein after-cast machining of the components are kept to a minimum.

SUMMARY OF THE INVENTION

Briefly described, a lifter oil manifold assembly for variable actuation of engine valves in accordance with the invention includes first (top) and second (valve) plates having portions of oil flow passages integrally formed therein. The plates are formed preferably of a die-cast metal such as aluminum. The assembly further comprises a carrier member also having portions of oil flow passages mating with the oil passages of the first and second plates. Further, the assembly includes towers for receiving and positioning the electromagnetic oil control valves used to control oil flow in the assembly. The towers are formed of a suitable polymer and many of the critical features of the towers are as-molded.

In one aspect of the invention, the oil supply passage is integral to the carrier. In another aspect of the invention, the towers are molded separate from the carrier and are held in place by the valve plate. In still another aspect of the invention, the towers are molded integral with the carrier. In yet other aspects of the invention, oil control valve retention springs are molded integral with either the tower or the oil control valve. In a further aspect of the invention, a combined polymer restrictor/strainer in the oil circuit of the lifter oil manifold assembly replaces a metal die-cast restrictor. The present hydraulic manifold results in an improved performance and in a savings in manufacturing cost over prior art manifolds.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
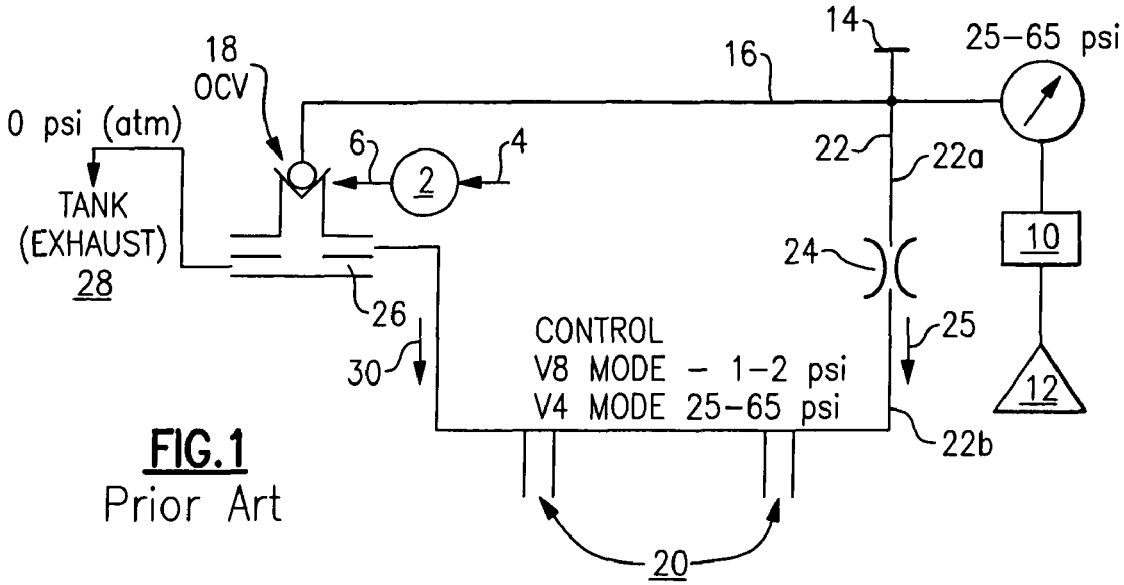
FIG.1 Prior Art
FIG. 1 is a schematic drawing of a prior art hydraulic circuit controlling the activation/deactivation of valves of one cylinder (this circuit would be repeated for each cylinder having a deactivation feature)

Referring to FIG. 1, the typical prior art engine oil circuit controlling a valve deactivation system for an internal combustion engine is shown. An engine control module (ECM) 2 receives input signals 4 from various sensors (not shown) and integrates via an algorithm such signals 4 with other input operating data such as oil temperature and engine speed to provide output signals 6 to energize or de-energize OCV 18. While only one OCV 18 and two lifters 20 for a single cylinder are shown in the schematic drawing, it should be understood that valve deactivation is useful only in multiple-cylinder engines for selectively reducing the number of combusting cylinders. Multiple-cylinder embodiments are discussed below.

In FIG. 1, an oil pump 10 feeds oil at a pressure of about 25-65 psi from sump 12 to a juncture 14 where the flow is split into at least two passages. A first passage 16 provides supply oil at a pressure of about 25-65 psi to the OCV 18. When OCV 18 is closed (as shown), oil supply passage 16 is deadheaded at the OCV 18. A second passage 22 from juncture 14 provides control oil via a passage segment 22*a* through metering valve orifice 24 whereby the oil pressure is reduced to about 1-2 psi in a passage segment 22*b*. Metering orifice 24 is configured in flow series with oil control passage 22 and may be about 0.5 mm in diameter. With OCV 18 closed, oil flows through control passage 22 in a first direction 25 toward deactivation lifters 20, at a reduced pressure, then through oil exhaust passage 26 where it is dumped back into the engine's oil reservoir 28. The deactivation lifters 20 are calibrated to deactivate when the pressure in oil supply passage 16 is above about 25 psi and to activate when the pressure in oil control passage 22*b* is below about 2 psi. With the OCV 18 closed, deactivation lifters 20 are in their activation mode. With OCV 18 open, the oil in supply oil passage 16 flows in a second direction 30 toward deactivation lifters 20, at a pressure above about 25 psi. As can be seen, metering valve 24 causes the line pressure in passage 22 to drop below a threshold pressure to cause the lifter to return to an activated mode. In the known prior art, metering valve orifice 24 is not immediately protected by a filter so that machining debris from the LOMA can migrate to orifice 24 and clog the metering passage.

Figure 2:
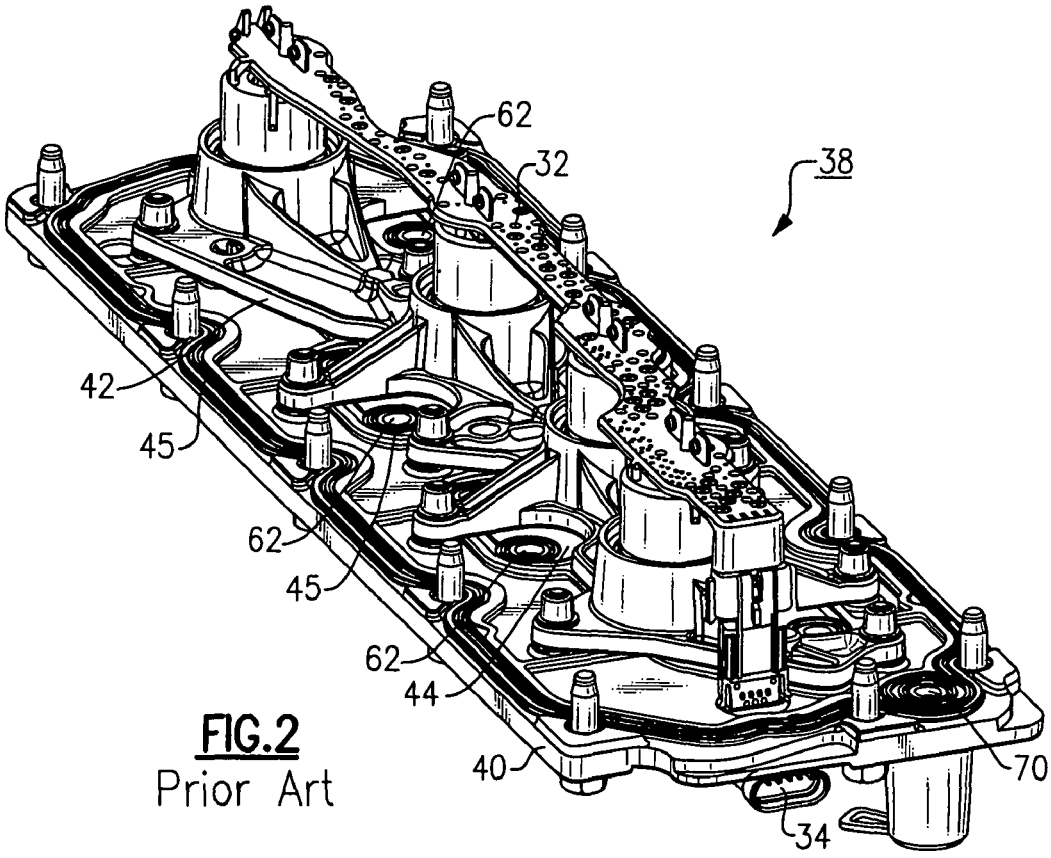
FIG.2 Prior Art
FIG. 2 is an isometric view of a prior art LOMA.
Figure 3:
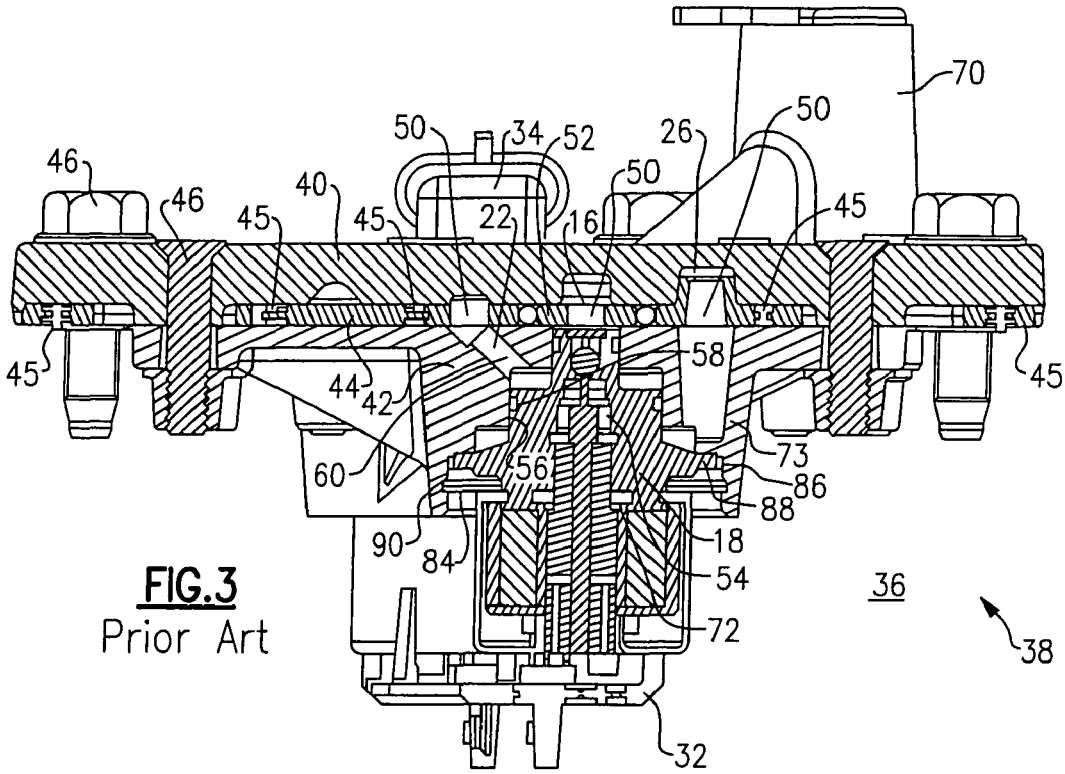
FIG.3 Prior Art
FIG. 3 is a cross-sectioned view of a prior art LOMA.

The benefits and advantages of an improved LOMA in accordance with the invention may be best appreciated by first considering a prior art LOMA 38 as shown in FIGS. 2-5. (FIG. 3 shows the LOMA in its installed position on the engine and FIG. 2 shows the LOMA inverted for clarity of component description). Prior art LOMA 38 includes a top plate 40, a valve plate 42, and a carrier 44 sandwiched between the top plate 40 and valve plate 42. Typically, the top 40 and valve 42 plates are formed by die casting of aluminum; the carrier 44 is formed of a composite material selected to optimize sealability and support. The two plates 40, 42 and carrier 44 are held together by fasteners 46 to form a complex oil distribution manifold. LOMA 38 also includes OCVs 18 and an electrical lead frame 32 for receiving electrical signals 6 from ECM 2 through connector 34 and transmitting the signals 6 to the OCVs 18, to open and close the valves as commanded by ECM 2.

When assembled, LOMA 38 may be installed into an internal combustion engine 36, for example, via bolts 48 extending through bores in top plate 40 and being secured, for example, onto engine block towers provided along opposite sides of the valley of a V-style engine, for operative control of the deactivation lifters 20 (FIG. 1) of the engine 36.

Carrier 44 is provided with a plurality of bores 50 extending completely through carrier 44 at selected locations for connecting oil passages in top plate 40 with oil passages in valve plate 42. Carrier 44 further includes patterns of resilient sealing beads 45 for sealing the LOMA 38 against the surface of the engine block 36 and between the mating surfaces of the top 40 and valve 42 plates to prevent oil leakage and "cross-talk" between oil supply passage 16, oil control passage 22, and oil exhaust passage 26. Typically, the patterns of sealing beads 45 are disposed in shallow grooves in surfaces of the carrier 44 into which the beads 45 may be fully compressed when LOMA 38 is assembled.

The oil passages 16, 22, and 26 in plates 40 and 42 and in carrier 44 and the sealing bead 45 patterns cooperate to define and form the oil galleries of a complex three dimensional LOMA 38 for selectively distributing pressurized oil from the block of engine 36 through an oil riser 70 to each of the plurality of OCVs 18 received in stepped sockets 72 formed in valve towers 73 of valve plate 42. OCVs 18 extend through valve plate 42 and the valve heads thereof seal against seats 52 on the underside of carrier 44. Stepped wells 54 and 56 are formed into the metal sockets 72, in secondary machining and finishing steps, after valve plate 42 is cast and provide a sealing surface for OCV o-rings 58 once the OCVs 18 are installed into the sockets 72. Each of the OCVs 18 controls the activation and deactivation of all valve lifters 20 for a given cylinder of a multi-cylinder engine via outlet ports 62 (one for the intake valve and one for the exhaust valve for each cylinder that is de-activatable) in LOMA 38; thus, four control valves 18 are required, for example, to deactivate valves for four cylinders of an eight-cylinder engine.

Oil is distributed along the manifold from riser 70 via a global supply gallery, which connects via bores (not shown) to OCVs 18. Riser 70 may be provided with an inline strainer (not shown) for catching debris trapped in the oil coming from the engine oil sump 12. Referring to FIG. 3, when OCV 18 is energized to open, oil is admitted past the OCV seat 52 and upwards through oil control drilling 60 in the valve plate for supplying the deactivation valve lifters 20. When OCV 18 is de-energized, oil flows continually through oil exhaust passage 26 back into the engine oil reservoir 28 (FIG. 1). This arrangement keeps oil control passage 22 filled with oil and thus prevents entry of air into the supply lines leading from the control valves 18 to the deactivation lifters 20 (FIG. 1).

A retainer 84, such as for example a c-clip, seated in a corresponding groove 86 formed in the inside wall of stepped socket 72 holds the OCVs 18 in their respective sockets 72. The installed inside diameter of retainer 84 is smaller than the outside diameter of OCV flange 88 thereby keeping the OCV 18 in place. A separate spring 90, such as a metal wave washer, disposed between flange 88 and retainer 84 loads the OCV 18 against valve plate 42.

Figure 4:
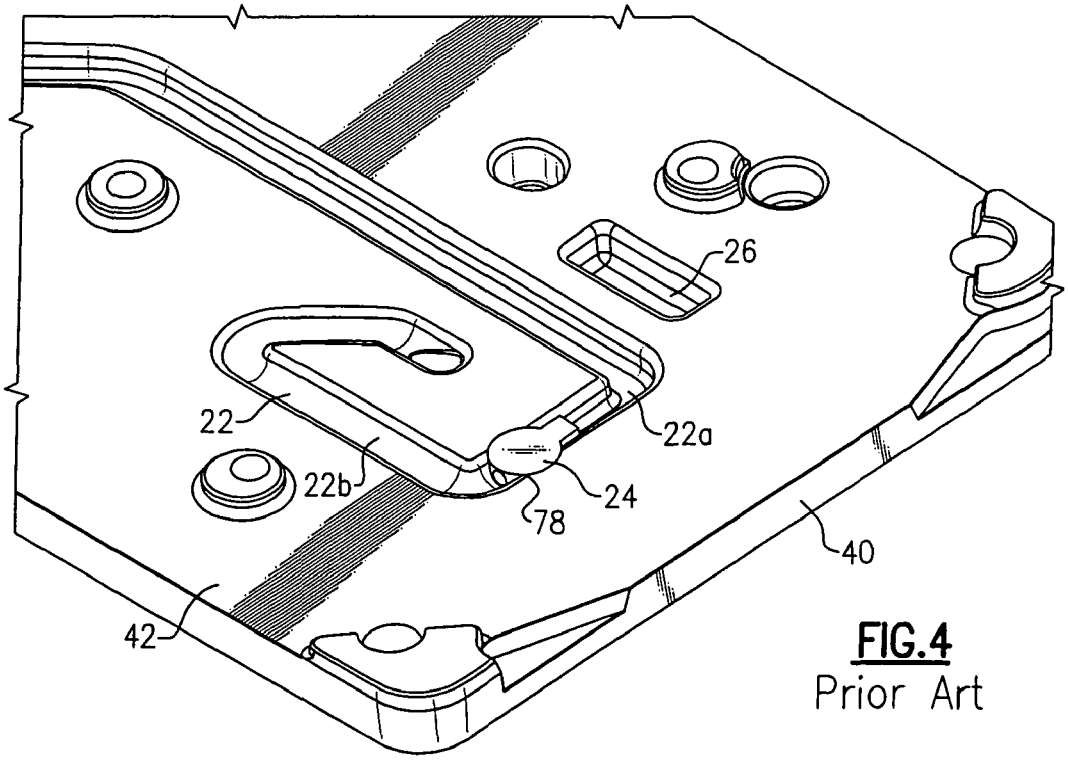
FIG.4 Prior Art
FIG. 4 is an isometric view of a top plate of a prior art LOMA showing a prior art metering valve in place.
Figure 5:
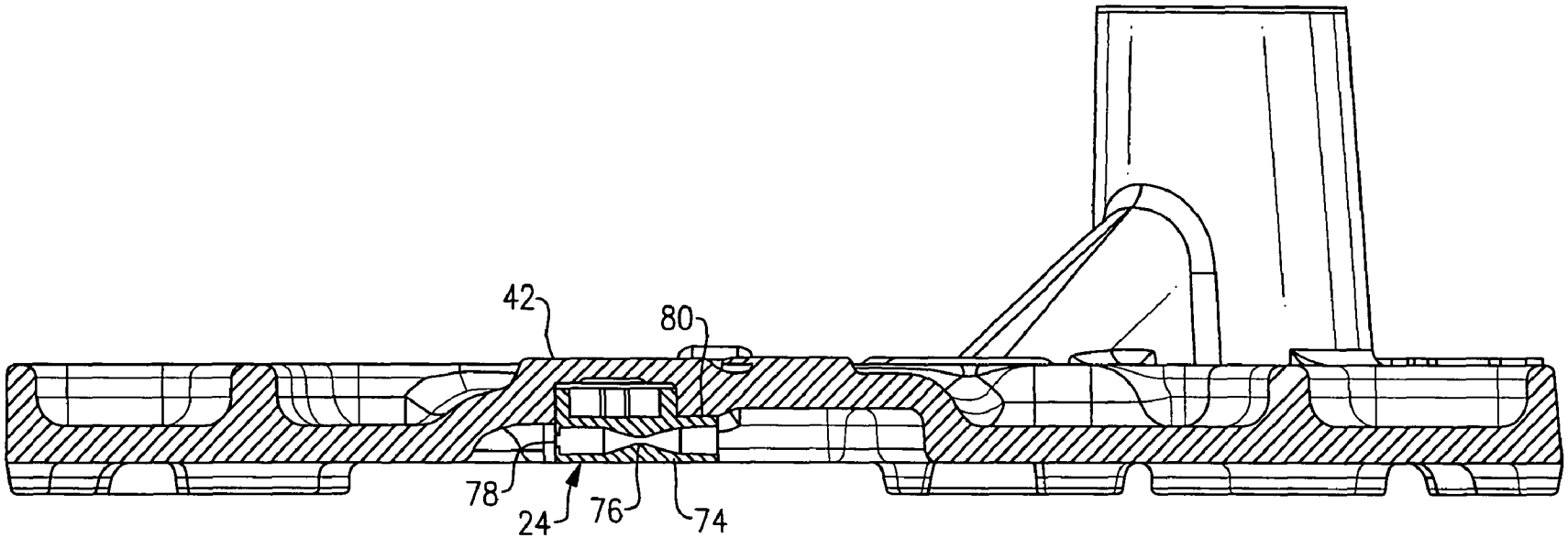
FIG.5 Prior Art
FIG. 5 is a cross-sectioned view of a top plate of a prior art LOMA showing a prior art metering valve in place.

Referring specifically to FIGS. 4 and 5, a typical prior art separate metering valve 24 is shown installed in series with oil control passage 22 formed in top plate 40. The general body 74 of valve 24 is formed of die cast metal, as for example zinc, and orifice restrictor 76 is precision machined into body 74 in a separate step following the die casting process. A pocket 78, assuming the thickness and shape of metering valve body 74, is machined into oil control channel 22 to press-fittedly receive metering valve 24. A cast shelf 80 also machined into oil control channel 22 serves to limit the depth in which valve 24 may be pressed into pocket 78 to thereby assure that a good and flat sealing surface remains between top plate 40 and carrier 44. As mentioned previously, a strainer (not shown) is typically positioned remote and well upstream from metering valve 24, such as at the interface between the block of engine 36 and the LOMA 38 near riser 70, for catching debris trapped in the oil coming from the engine oil sump 12 (FIG. 1). Chips and debris left from the various processes performed in machining and manufacturing LOMA 38 cannot be trapped by the strainer because of its location and are permitted to migrate toward and collect at the orifice restrictor 76. The strainer may further be molded in place, welded, snapped in place, or bonded in some other manner.

Figure 6:
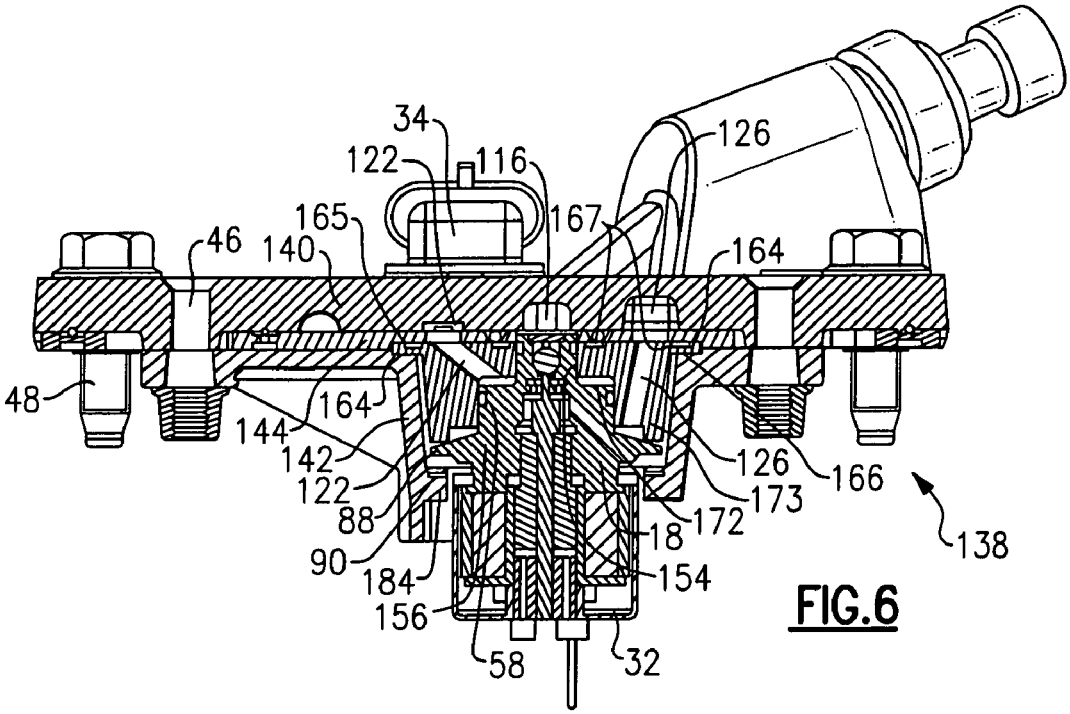
FIG. 6 is a cross-sectioned view of a first embodiment of a LOMA in accordance with the invention.
Figure 7:
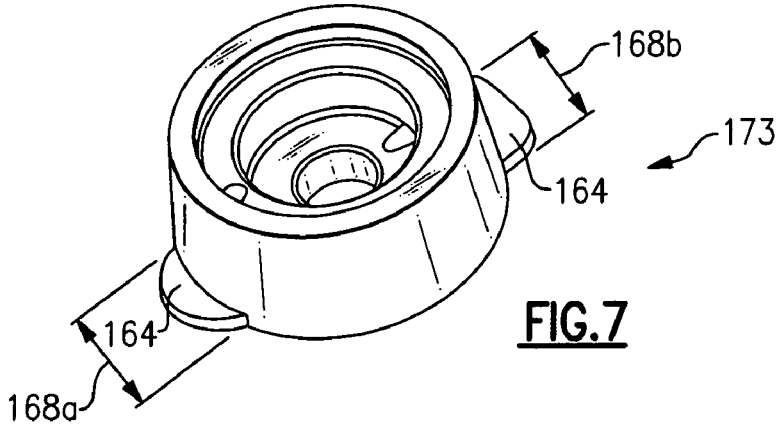
FIGS. 7 and 8 are isometric views of the OCV tower as shown in FIG. 5, in accordance with the invention.
Figure 8:
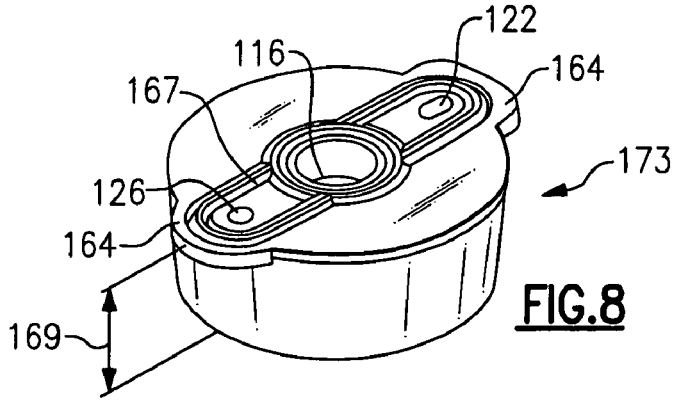

Referring to FIGS. 6-8, an improved LOMA 138 representing a first embodiment of the invention in which the OCV socket towers are formed as separate non-metal components is shown. (Note: features identical with those in prior art LOMA 38 carry the same numbers; features analogous but not identical carry the same numbers but in the 100 series.) Improved LOMA 138 includes a revised top plate 140, a revised valve plate 142, and a revised carrier 144 sandwiched between the top plate 140 and valve plate 142. As before, the top 140 and valve 142 plates are preferably formed by die casting of aluminum. However, OCV socket towers 173 are formed as separate components, are preferably molded of a heat stabilized polymer such as nylon 66, and are held in place by valve plate 142, as will be explained in more detail below. An aspect of the invention is that sockets 172 and particularly stepped wells 154 and 156 are as-molded without the need for secondary machining. As-molded surfaces of stepped wells 154 and 156 provide a sealing surface for OCV o-rings 58 once the OCVs 18 are installed into the sockets 172. Flange ears 164 at the base of each molded tower 173 extend radially outward from the base of the tower 173 and fit into similarly shaped pockets 165, formed in the carrier 144. Similarly shaped recesses 166 are formed in the mating surface of valve plate 142 so that, when the LOMA is assembled, tower 173 is trapped in place between the top plate 140 and valve plate 144. Resilient seal 167 serves to seal oil supply 116, oil control 122, and oil exhaust 126 passages from each other and further serves to take up any tolerances between the thickness of flange ears 164 and the gap for ears 164 provided by pockets 165 and recesses 166. A clocking feature, such as, for example, making the width 168*a* of one of the flange ears of a different size than the width 168*b* of the other ear to assure that oil passages 122, 126, formed in tower 173 will align properly with the associated passage 122 or 126 formed in carrier 144 and top plate 140 when the tower is assembled into LOMA 138.

The two plates 140 and 142, carrier 144, and OCV 18 are held together by fasteners 46 to form LOMA 138. Note that an inward facing flange 184, formed as part of valve plate 142, serves to keep OCV 18 in place after LOMA 138 is assembled thereby replacing retainer 84 and machined groove 86 in the prior art. The axial height 169 of tower 173, including the thickness of resilient seal 167 extending below the bottom surface of tower 173, and the thickness of OCV flange 88, are sized to be slightly less than the axial length provided for the tower between the bottom surface of pocket 165 and the underside of valve plate flange 184. The slight clearance may be taken up by separate spring 90, such as for example a metal wave washer, disposed between OCV flange 88 and valve plate flange 184 and to thereby load the OCV 18 against socket tower 173 and carrier 144. LOMA 138 also includes electrical lead frame 32 for receiving electrical signals 6 from ECM 2 through connector 34 and transmitting signals 6 to OCVs 18. After assembly, LOMA 138 may be installed into an internal combustion engine 36, for example, via bolts 48 extending through bores in top plate 140 and being secured, for example, onto engine block towers provided along opposite sides of the valley of a V-style engine.

Figure 9:
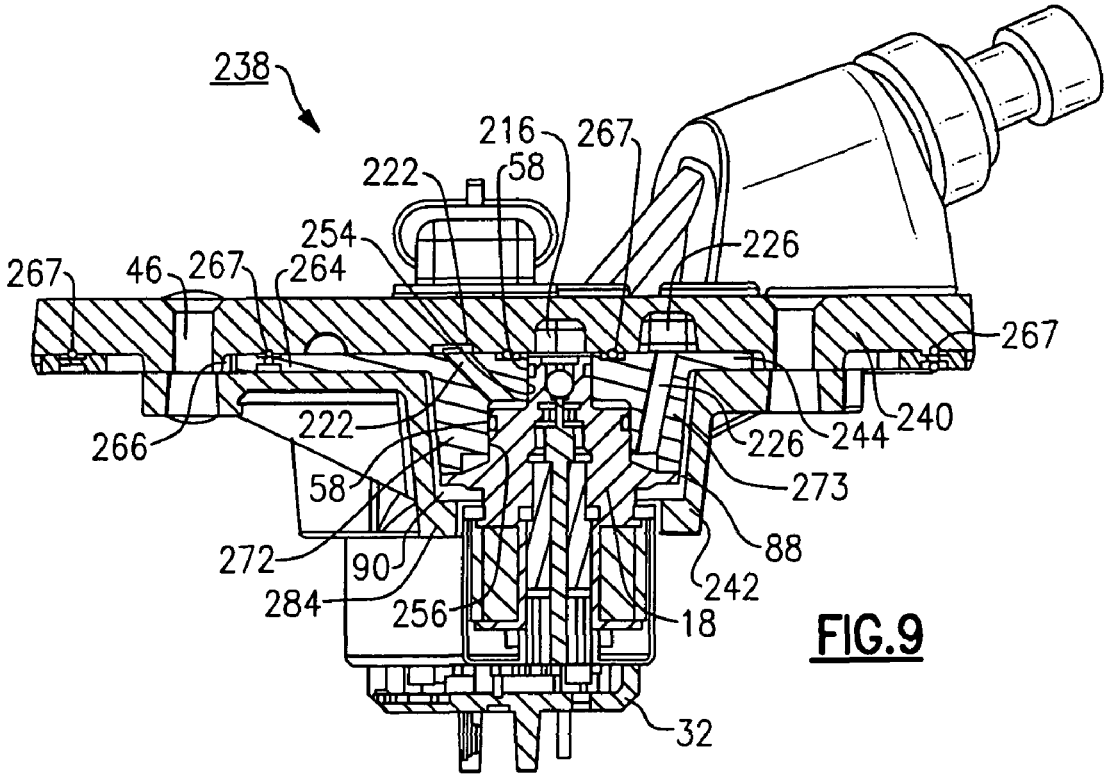
FIG. 9 is a cross-sectioned view of a second embodiment of a LOMA in accordance with the invention.

Referring to FIG. 9, an improved LOMA 238 representing a second embodiment of the invention in which the OCV socket towers are formed integral with the carrier plate is shown. (Note: features identical with those in prior art LOMA 38 and first embodiment LOMA 138 carry the same numbers; features analogous but not identical carry the same numbers but in the 200 series.) Improved LOMA 238 includes a revised top plate 240, a revised valve plate 242, and a revised carrier 244 sandwiched between the top 240 and valve 242 plates. The top 240 and valve 242 plates are preferably formed by die casting of aluminum. Differing from LOMA 138, OCV socket towers 273 are formed integral with carrier 244 and, together, are preferably molded of a heat stabilized polymer such as nylon 66 as a single part. An aspect of the invention is that sockets 272 and stepped wells 254 and 256 are molded into socket towers 273 without the need for secondary machining. As-molded surfaces of wells 254 and 256 provide a sealing surface for OCV o-rings 58 once the OCVs 18 are installed into sockets 272. A recess 266 is formed in the mating surface of top plate 240 so that, when LOMA 238 is assembled, the footprint of integrated carrier/tower 244 is close-fittedly received in the recess 266 and carrier/tower 244 is trapped in place between the top plate 240 and valve plate 242. Resilient seals 267 serve to seal oil supply 216, oil control 222 and oil exhaust 226 passages from each other and further serve to take up any tolerances between the thickness of foot print flange 264 and the gap for the flange provided by recess 266.

The two plates 240, 242, carrier 244, and OCV 18 are held together by fasteners 46 to form LOMA 238. Note that an inward facing flange 284, formed as part of valve plate 242, serves to keep OCV 18 in place after LOMA 238 is assembled thereby replacing retainer 84 and machined groove 86 in the prior art. The axial height of tower 273, including the thickness of resilient seal 267 extending below the bottom surface of tower 273, and the thickness of OCV flange 88, are sized to be slightly less than the axial length provided for the tower between the bottom surface of recess 266 and the underside of valve plate flange 284. The slight clearance may be taken up by separate spring 90, such as for example a metal wave washer, disposed between OCV flange 88 and valve plate flange 284 and to thereby load OCV 18 against carrier 244. LOMA 238 also includes electrical lead frame 32 for receiving electrical signals 6 from ECM 2 through connector 34 and transmitting signals 6 to OCVs 18.

Figure 10:
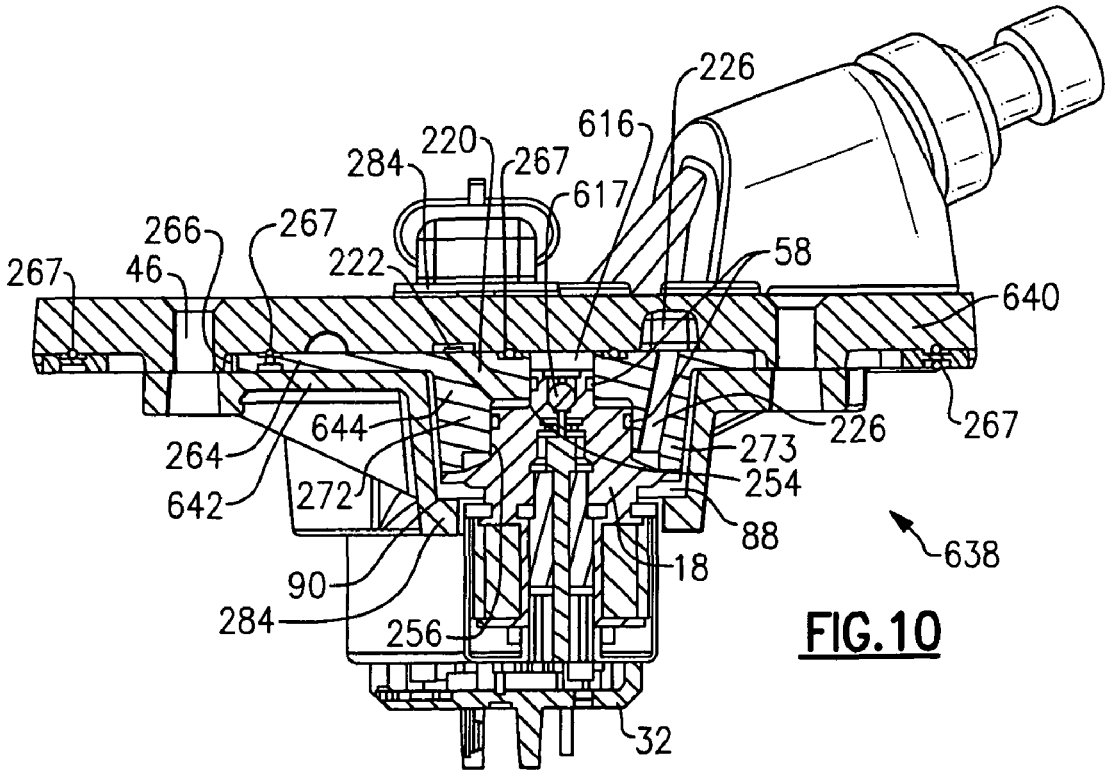
FIG. 10 is a cross-sectioned view of a LOMA with a full depth oil supply gallery, in accordance with a third embodiment of the present invention.
Figure 11:
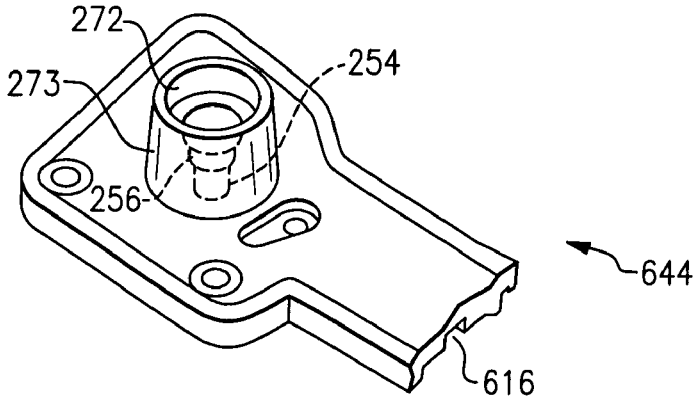
FIG. 11 is an isometric view of a carrier with an integral oil supply gallery, in accordance with the third embodiment of the invention.

Referring to FIGS. 10 through 11, an improved LOMA 638 with a full depth oil supply gallery representing a third embodiment of the present invention in which the oil supply passage is integral to the carrier is shown. (Note: features identical with those in prior art LOMA 38, first embodiment LOMA 138, and second embodiment LOMA 238 carry the same numbers; features analogous but not identical carry the same numbers but in the 600 series.) Improved LOMA 638 includes a revised top plate 640, a valve plate 642, and a revised carrier 644 sandwiched between top plate 640 and valve plate 642. Carrier 644 includes an integral oil supply passage 616 having a full depth 617.

Valve plate 642 is comparable to valve plate 242 shown in FIG. 9. The top 640 and valve 242 plates are preferably formed by die casting of aluminum.

Analogous to LOMA 238 shown in FIG. 9, OCV socket towers 273 are formed integral with carrier 644 and, together, are preferably molded of a heat stabilized polymer such as nylon 66 as a single part. Sockets 272 and stepped wells 254 and 256 are molded into sockets 272 without the need for secondary machining. As-molded surfaces of wells 254 and 256 provide a sealing surface for OCV o-rings 58 once the OCVs 18 are installed into sockets 272. A recess 266 is formed in the mating surface of top plate 240 so that, when LOMA 638 is assembled, the footprint of integrated carrier/tower 644 is close-fittedly received in the recess 266 and carrier/tower 644 is trapped in place between the top plate 640 and valve plate 642. Resilient seals 267 serve to seal oil supply 716, oil control 222, and oil exhaust 226 passages from each other and further serve to take up any tolerances between the thickness of foot print flange 264 and the gap for the flange provided by recess 266. Furthermore, assembly of plates 640 and 642, carrier 644, and OCVs 18 to form LOMA 638 is similar to the assembly of LOMA 238 as described above in connection with FIG. 9.

Differing from LOMA 238 shown in FIG. 9, oil supply passage 616 is integrated into carrier 644 instead of into top plate 640. Accordingly, top plate 640 of LOMA 638 does not include an oil supply passage 216 as does top plate 240 of LOMA 238 (FIG. 9). Integrating oil supply passage 616 into carrier 644 in accordance with the third embodiment of the present invention, results in an oil supply path and an oil control path in different surfaces.

As shown in FIG. 11, socket towers 273 and oil supply passage 616 are formed integral with carrier 644 as a single integral part. Oil supply passage 616 may be a groove or channel that is integrated into carrier 644, for example, molded into carrier 644, thus, eliminating any secondary machining operations. Oil supply passage 616 leads directly to socket 272 and, therefore, to OCV 18 when installed. No changes to socket tower 273 are needed compared to LOMA 238 shown in FIG. 9. Oil supply passage 616 extends vertically all the way to the surface of carrier 644 that mates with top plate 640. Accordingly a maximum depth 617 of oil supply passage 616 can be achieved.

Figure 12:
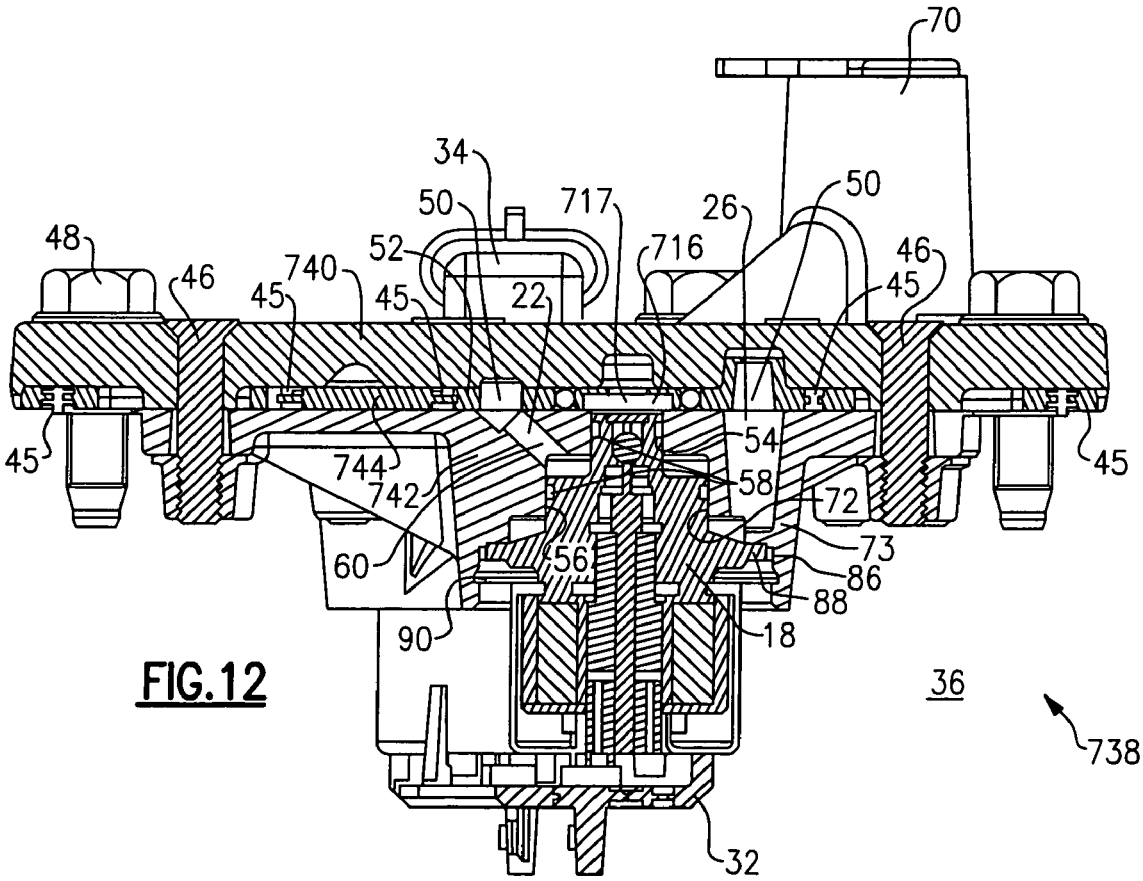
FIG. 12 is a cross-sectioned view of a LOMA with a partial depth oil supply gallery, in accordance with the third embodiment of the present invention.

Referring to FIG. 12, an improved LOMA 738 with a partial depth oil supply gallery representing the third embodiment of the present invention in which the oil supply passage is integral to the carrier is shown. (Note: features identical with those in prior art LOMA 38, first embodiment LOMA 138, and second embodiment LOMA 238 carry the same numbers; features analogous but not identical carry the same numbers but in the 700 series.) Improved LOMA 738 includes a revised top plate 740, a valve plate 742, and a revised carrier 744 sandwiched between top plate 740 and valve plate 742. Carrier 744 includes an integral oil supply passage 716 having a partial depth 717. Valve plate 742 is comparable to prior art valve plate 42 shown in FIG. 3. As before, the top 740 and valve 742 plates are preferably formed by die casting of aluminum.

Analogous to prior art LOMA 38 shown in FIG. 3, OCV socket towers 73 are formed integral with valve plate 742 as is explained in more detail above.

Differing from prior art LOMA 38 shown in FIG. 3, oil supply passage 716 is integrated into carrier 744 instead of into top plate 40. Accordingly, top plate 740 of LOMA 738 does not include an oil supply passage 116 as does top plate 40 of LOMA 38 (FIG. 3). Integrating oil supply passage 716 into carrier 744 in accordance with the third embodiment of the present invention, results in an oil supply path and an oil control path in different surfaces. Oil supply passage 716 is formed integral with carrier 744 as a single integral part. Oil supply passage 716 may be a groove or channel that is formed in carrier 744, for example, by a secondary machining operation, such that an open end of the groove faces socket 72. Oil supply passage 716 leads directly to sockets 72 and, therefore, to OCV 18 when installed. Contrary to oil supply passage 616, oil supply passage 716 is formed in carrier 744 such that the channel or groove does not extend vertically all the way to the surface of carrier 744 that mates with top plate 740. As a result, the depth 717 of oil supply passage 716 is less than the depth 617 of oil supply passage 616 and it may be possible to eliminate resilient seals 267 (FIG. 10) that surround oil supply passage 616 of LOMA 638.

While the oil supply passage is shown integrated into the carrier of LOMA 238 and into the carrier of prior art LOMA 38, it is understood that the third embodiment of the invention could also be used in conjunction with LOMA 138. Accordingly, it may be possible to integrate oil supply passage 116 of LOMA 138 (FIG. 6) into carrier 144 instead of into top plate 140 as shown in FIG. 3. Oil supply passage 116 may be integrated into carrier 144 to have a full depth 617 or a partial depth 717.

Figure 13:
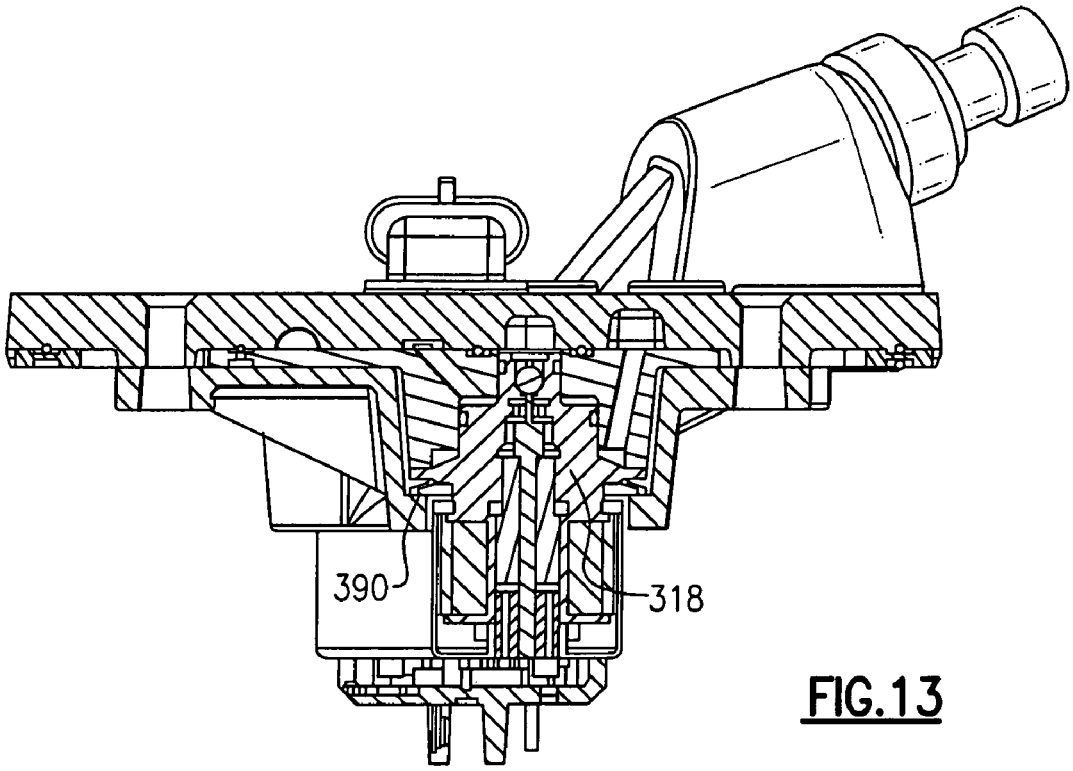
FIG. 13 is a cross-sectioned view of another embodiment of a LOMA in accordance with the invention.
Figure 14:
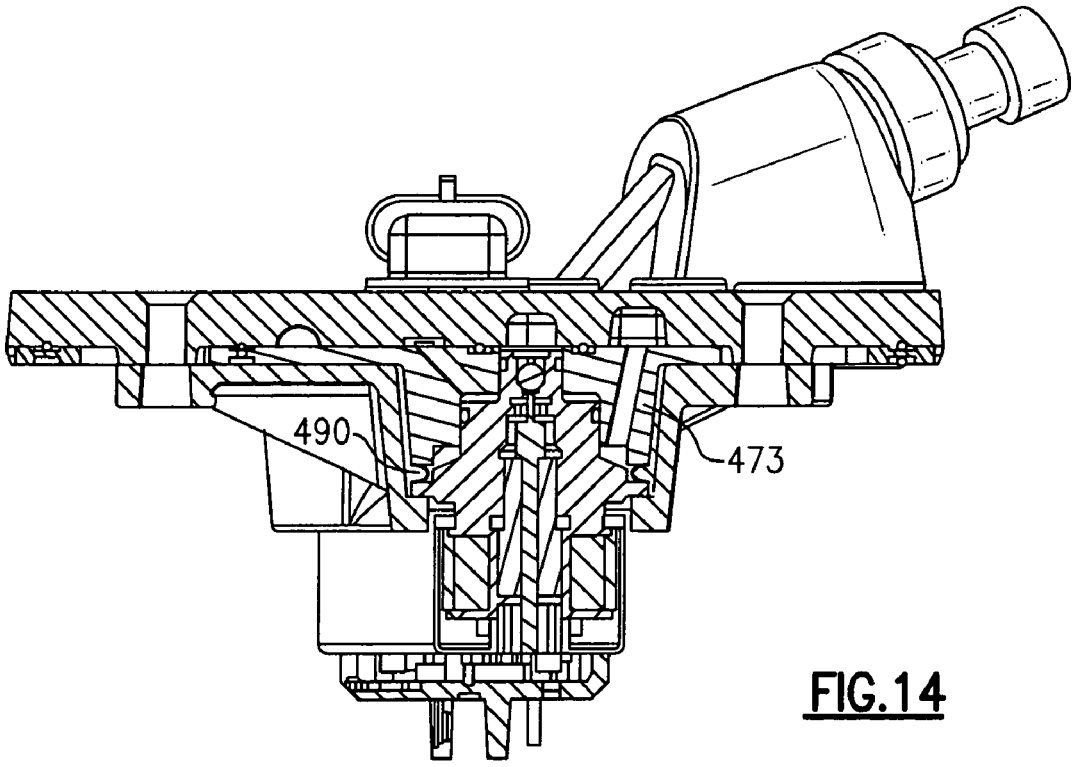
FIG. 14 is a cross-sectioned view of still another embodiment of a LOMA in accordance with the invention.

Referring now to FIGS. 13 and 14, additional aspects of an improved LOMA, in accordance with the invention, are shown. In these figures, separate spring 90 is replaced with spring member 390 formed either integrally with OCV 318

(FIG. 13) or spring member 490 formed integrally with socket tower 473 (FIG. 14). In both cases, the spring member is formed of the same material used to form the body of OCV 318 or socket tower 473. The size, shape, and stiffness of integrated spring member 390, 490 could be readily determined by one skilled in the art without undue experimentation. While the integrated spring member 390 is shown in FIGS. 13 and 14 in reference to LOMAs 238 and 638 (shown in FIGS. 6 and 12, respectively) having the OCV tower formed integral with the carrier, it is understood that this aspect of the invention could also be used in conjunction with LOMAs 138 and 738 (shown in FIGS. 9. and 10, respectively) or in conjunction with the prior art LOMA 38 shown in FIG. 3.

In yet another aspect of the invention, the metal die-cast metering valve 24 (as shown in FIGS. 1 and 4) is replaced with a metering valve molded of a non-metallic material requiring no after-molding machining and having an integrated strainer. Referring again to FIG. 1, the prior art LOMA hydraulic circuit includes metering valve 24 disposed in series with oil control passage 22. Orifice restrictor 76 (FIG. 5) is precision machined into body 74 of metering valve 24 before the valve is pressed into pocket 78 of top plate 42 (FIGS. 4 and 5). Orifice restrictor 76 serves to reduce the line pressure in passage 22 from a level of about greater than 25 psi upstream of valve 24 to a level of about less than 2 psi. To achieve the needed pressure drop across the valve, orifice restrictor 76 must be exceptionally small—in the order of about 0.5 mm in diameter. It is known in the art to place a separate strainer in the circuit well upstream of the restrictor in order to trap debris in the engine lubricating oil. However, placing the strainer remote from the restrictor does not serve to trap debris, such as chips and flashing left in the LOMA during its manufacturing process. This debris is known to migrate toward and clog the restrictor that otherwise could not be trapped by the prior art remotely located strainer. By integrating with the metering valve so that the orifice restrictor is close to the strainer, the orifice restrictor is better protected from all trapped debris including debris from within the LOMA. The strainer can be molded in place, welded, snapped in, or bonded in some other manner.

Figure 15:
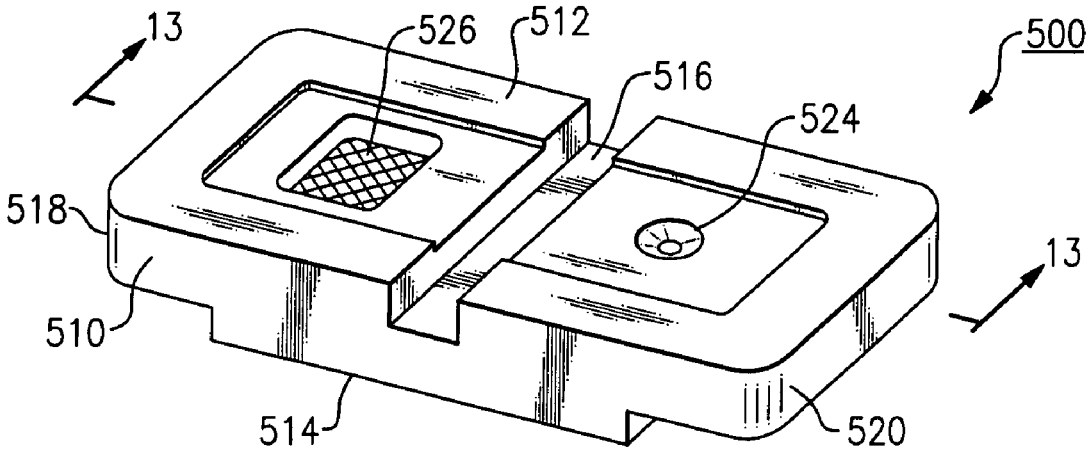
FIG. 15 is an isometric view of the restrictor/strainer assembly, in accordance with the invention.

Referring to FIGS. 15-18, an integrated orifice restrictor/strainer (ORS) is shown. ORS 500 includes hollow elongate body 512 having generally planar top plate surface 512 and stepped carrier surface 514. Planar top plate surface 512 defines lateral seal channel 516 disposed at approximately a midpoint between sides 518, 520 of body 510. Between channel 516 and side 520, surface 512 defines restrictor orifice 524. Between channel 516 and side 518, surface 512 defines strainer member 526. Referring to FIG. 15, restrictor 524 is in fluid communication with strainer 526 via internal flow chamber 528. Other than through orifice restrictor 524 and strainer 526, fluid chamber 528 is sealed from the outside of body 510. ORS may be formed entirely as shown, in the molding process, without additional machining or fabricating, as known in the art.

Figure 17:
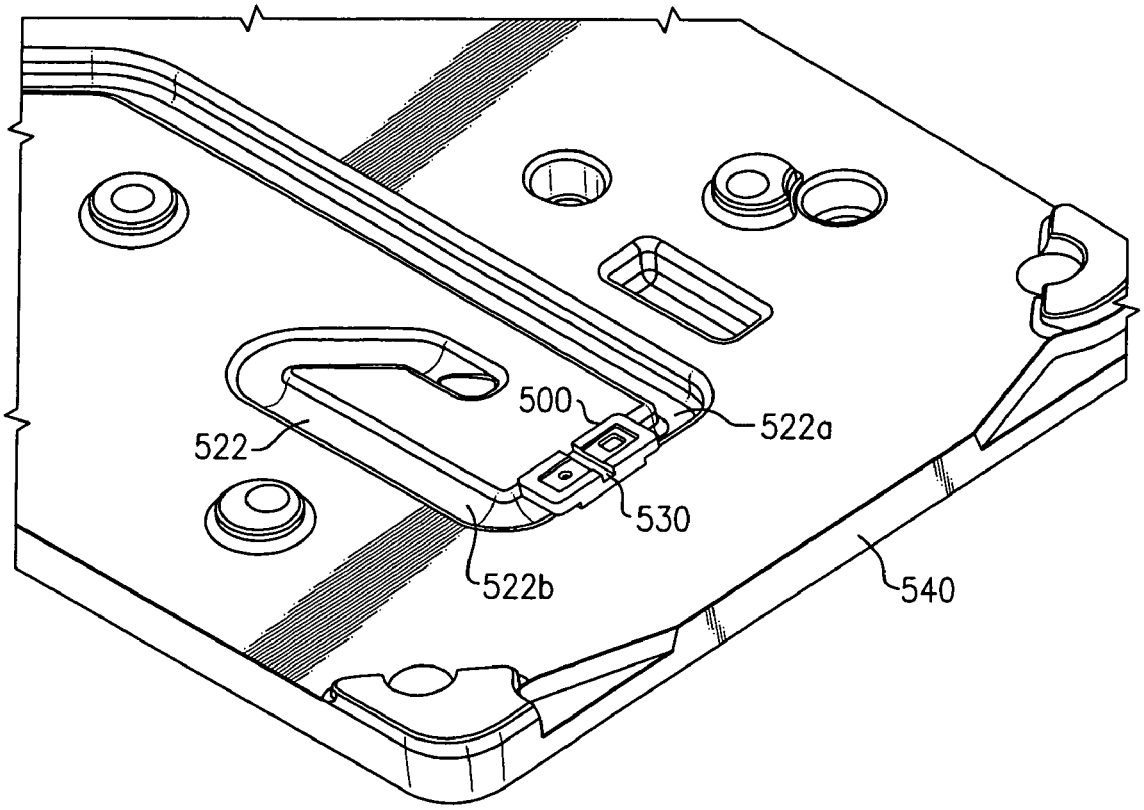
FIG. 17 is an isometric view of a top plate of a LOMA showing the restrictor/strainer assembly, in accordance with the invention, in place.

Referring now to FIG. 17, top plate 540, including control passage 522 formed in top plate 540 is shown. Also shown, in transparent view is ORS 500 positioned over control passage 522. Control passage 522 is modified from passage 22 shown in FIG. 4 in that dam 530 has been added completely blocking off the cross section of passage 522 between passage segment 522*a* upstream of ORS 500 and passage segment 522*b* downstream of ORS 500. ORS provides a bridged passageway over dam 530, as will now be described.

Figure 18:
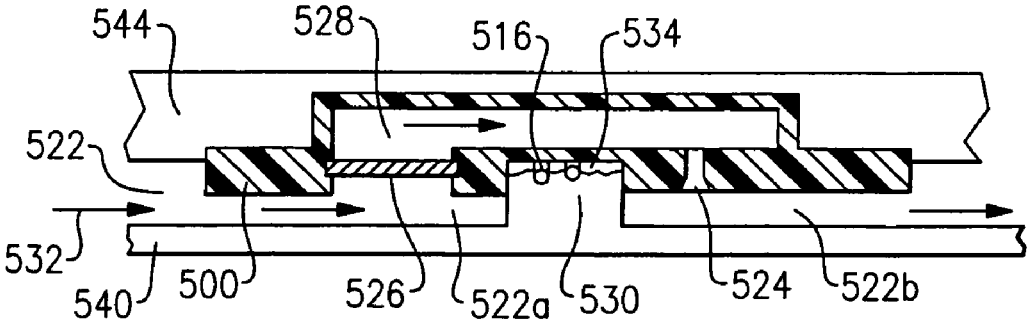
FIG. 18 is a cross-sectioned view of the restrictor/strainer installed between the valve plate and carrier, in accordance with the invention.

Referring to FIG. 18, ORS 500 is shown residing adjacent top plate 540. Pressurized oil 532 from pump 10 (FIG. 1) flows (from left to right in FIG. 18) through oil control passage 522 through strainer 526, where debris from the LOMA can be trapped, up through chamber 528, then returning to passage 522*b* through orifice restrictor 524. From there oil at a reduced pressure flows to the deactivation lifters 20 (FIG. 1). To prevent undesirable leakage of oil between dam 530 and channel 516, a resilient sealant 534 may be applied to either the dam of the channel surface.

Figure 16:
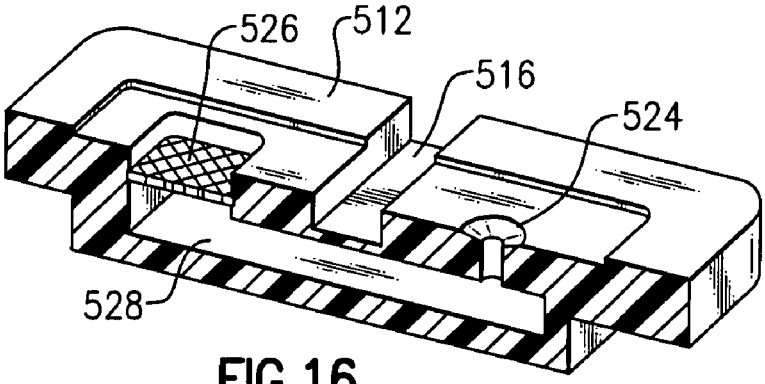
FIG. 16 is an isometric sectional view taken along line 13-13 in FIG. 12.

ORS 500 may be molded as a separate component as shown in FIGS. 15, 16, and 18, or may be molded integrally with carrier 544. It is understood that the embodiment shown in FIGS. 15-18 may be used in conjunction with any of the other embodiments shown herein, in accordance with the invention, or may be used in conjunction with the prior art LOMA, either molded separately of integrally with carrier 44.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A lifter oil manifold assembly including at least one oil control valve for activation and deactivation of valves in a multiple-cylinder internal combustion engine having a pressurized oil source and hydraulically-operable deactivation valve lifters, comprising:

a) a first plate having on one side thereof a first mating surface formed in a first pattern delineating first portions of oil control and oil exhaust passages in said assembly;

b) a second plate having on one side thereof a second mating surface that faces said first mating surface formed in a second pattern;

c) a carrier having a third mating surface and a fourth mating surface opposite said third mating surface, said carrier defining portions of said oil control and oil exhaust passages, said carrier having an oil supply passage integrated separate from said portions of said oil control and said oil exhaust passages, said third mating surface mating with said first mating surface, and said fourth mating surface mating with said second mating surface; and d) a tower disposed between said first plate and said second plate for receiving said at least one oil control valve and retained by said second plate.

2. A manifold assembly in accordance with claim 1 wherein said tower is formed of a non-metallic material.

3. A manifold assembly in accordance with claim 1 wherein said tower is formed integral with said carrier.

4. A manifold assembly in accordance with claim 1 further including a spring member disposed between said second plate and said oil control valve for biasing said valve toward said first plate.

5. A manifold assembly in accordance with claim 1 wherein said oil supply passage leads to a socket integrated into said tower.

6. A lifter oil manifold assembly including at least one oil control valve for activation and deactivation of valves in a multiple-cylinder internal combustion engine having a pressurized oil source and hydraulically-operable deactivation valve lifters, comprising:

a) a top plate including an oil control passage and an oil exhaust passage formed in a first mating surface thereof;

b) a valve plate having a second mating surface that faces said first mating surface;

c) a molded polymer carrier sandwiched between first mating surface of said top plate and said second mating surface of said valve plate, wherein an oil supply passage and at least one socket tower for receiving said at least one oil control valve are formed integral with said carrier as a single part; and d) a spring member disposed between said valve plate and said oil control valve for biasing said valve toward said top plate.

7. A manifold assembly in accordance with claim 6 wherein said socket tower includes a plurality of molded sockets and stepped wells that receive said oil control valve, wherein said sockets and stepped walls provide sealing surfaces for sealing elements of said oil control valve.

8. A manifold assembly in accordance with claim 6 wherein said first mating surface of said top plate includes a recess that receives a footprint of said carrier.

9. A manifold assembly in accordance with claim 6 further including a resilient seal positioned between said first mating surface of said top plate and said carrier, wherein said resilient seal seals said oil control passage and said oil exhaust passage from each other.

* * * * *